US006048591A

United States Patent [19]

Zwiebel

[11] Patent Number: 6,048,591

[45] Date of Patent: Apr. 11, 2000

[54] CHRISTMAS TREE ORNAMENT

[76] Inventor: Chong Ye Zwiebel, Rte. 2 Box 124, Ainsworth, Nebr. 69210

[21] Appl. No.: 09/226,203

[22] Filed: Jan. 7, 1999

[51] Int. Cl.[7] ..... A47G 33/08; A63H 27/10

[52] U.S. Cl. ..... 428/12; 428/9; 428/13; 446/220

[58] Field of Search ..... 428/99, 9, 12, 428/13; 446/220, 226

[56] References Cited

U.S. PATENT DOCUMENTS

| | | | |
|---|---|---|---|
| D. 294,128 | 2/1988 | Patricko | D11/129 |
| 3,035,162 | 5/1962 | Emmich | 428/11 |
| 3,900,638 | 8/1975 | DuBato | 428/11 |
| 4,358,487 | 11/1982 | Walker | 428/11 |

FOREIGN PATENT DOCUMENTS 850 793 9/1952 Germany .

*Primary Examiner*—Alexander Thomas
*Attorney, Agent, or Firm*—Richard C. Litman

[57] ABSTRACT

An ornament includes a collapsible housing constructed preferably of polyvinyl chloride and provided with an air valve allowing of selective inflation and deflation of the housing. Contained within the interior of the housing is a tethered figurine, along with a measured amount of particulate material simulating snowflakes. By employing foamed polystyrene as the particulate material, a composition is utilized which exhibits a natural affinity towards clinging to the inner wall of the housing. Upon inflation of the housing, which includes a hanger formation at its top, the figurine is displayed as a freely suspended member within the housing while the particles of foamed polystyrene are attracted to and cling to the wall of the housing in a scattered or random manner. The material of the housing may be transparent or alternatively, be translucent with a slight degree of opacity.

11 Claims, 1 Drawing Sheet

CHRISTMAS TREE ORNAMENT

BACKGROUND OF THE INVENTION

1. Field of the Invention

This invention relates generally to holiday ornaments and more particularly, to an improved inflatable Christmas tree ornament including a transparent envelope containing simulated snow and a suspended, interior element.

2. Description of the Related Art

Holiday ornaments having a generally circular cross-section are well known. Among these are the popular hollow, spherical or globular devices adapted to be suspended from a tree limb or the like and which comprise a usually opaque member of either a frangible glass-like substance or which may be constructed of plastics. In either instance, any enhanced ornamentation is limited to coloring of the material of the device or, the application of various designs thereto. Alternatively, the body of the device may be molded in a manner to produce three-dimensional male or female formations.

Alteration of the above described most common types of ornament has included the use of an inflatable spherical member as well as the introduction of disparate elements into the hollow interior thereof.

An example of a hollow Christmas tree ball or ornament containing a figurine therein will be found in German Pat. No. 850,793 issued Sep. 29, 1951 to Schmidt and which discloses a spherical ball formed of two transparent, rigid, semi-spherical sections interlocked together after the suspension of a figurine therein. Unlike the teaching of the present invention, the Schmidt device fails to suggest the use of a unitary, flexible, inflatable globe member or the inclusion of simulated snow as formed by a substance having a natural affinity leading to its random attachment or clinging to the interior of the globe member.

U.S. Pat. No. 3,035,162 issued to Emmich on May 15, 1962 illustrates a Christmas tree ornament depicting a spherical member which may include a design figure embossed thereupon. The rigid member is transparent and contains white flocculent material representative of snow such that when a source of pressurized air is introduced at the bottom of the member, this material is projected upwardly within the hollow interior. The Emmich disclosure is devoid of the instant arrangement wherein a normally collapsed, flexible member is inflated to provide a globe member and contains simulated snow as formed by a substance having a natural affinity leading to its random attachment or clinging to the interior of the globe member.

U.S. Pat. No. 3,900,638 issued Aug. 19, 1975 to Du Bato illustrates the concept of a Christmas tree ornament including a flexible, inflatable member provided with an orifice and sleeve at its upper end for inflation of the member. An adjacent, tethered plug serves to seal the member when inflated with the tether then providing a loop for receiving a hook to attach the ornament to a tree limb. The present invention, on the other hand, provides a suspended figure within a transparent spherical member, together with a material simulating snow and which is selected for its property of inherently randomly clinging to the interior of a hollow member.

Another example of an inflatable ornament will be found in U.S. Pat. No. 4,358,487 issued to Walker on Nov. 9, 1982 and wherein the body includes a pair of joined flexible composite sheets provided with a non-elastomeric layer as well as a reflective coating. The top of the juncture of the two sheets includes a filling valve structure which also provides a formation for hanging the ornament. The current invention differs from the above by its inclusion of a suspended figure within the interior as well as a filling of a simulated snow composition naturally reacting with the material of the member to randomly cling to its interior surface.

Another example of a Christmas tree ornament containing a suspended figurine therein will be seen in U.S. Design Pat. No. 294,128 issued to Patricko on Feb. 9, 1988. The drawings of this reference illustrate a figure suspended within the confines of an expanded, helical element. The foregoing teaching is far removed from the present construction involving an inflated, transparent, flexible sphere having a figurine suspended therewithin, together with simulated snow material selected to be naturally attracted to the interior of the sphere.

None of the above inventions and patents, taken either singly or in any combination, is seen to even remotely suggest or describe the instant invention as claimed herein.

SUMMARY OF THE INVENTION

By the present invention, an improved ornament is provided comprising a flexible, inflatable member of suitable plastics material, preferably transparent and having an air valve allowing of inflation and deflation at the will of the user. A formation at the top of the flexible member accommodates a hanging element permitting of attachment of the ornament to a tree limb, for example.

Tethered within the flexible member is a figurine such that its tether freely suspends the figurine following inflation of the ornament.

A measure of particulate material, such as foamed polystyrene, is disposed within the flexible member and serves to simulate snow. Due to the natural static attraction between the plastics composition of the flexible member and the particulate material, this material randomly clings to the interior of the inflated member to replicate a snowfall surrounding the suspended figurine.

Accordingly, one of the objects of the present invention is to provide an improved ornament including a transparent hollow member containing particulate material replicating snow and which naturally is attracted to and clings to the interior of the hollow member in a random fashion.

Another object of the present invention is to provide an improved ornament including an inflatable, transparent member containing material within the interior that simulates snow and which naturally adheres to the inner surface of the member, in a random fashion.

A further object of the present invention is to provide an improved ornament including an inflatable balloon-like member, either transparent or translucent, containing particulate material representative of snow, together with a figurine suspended within the interior thereof and wherein the particulate material naturally clings to the member inner wall.

Still another object of the present invention is to provide an improved ornament including a selectively inflatable and deflatable member admitting of light and provided with a device for hanging the member from a tree limb, together with an interior figurine and material representative of snow and naturally clinging to the interior of the member.

These and other objects of the present invention will become readily apparent upon further review of the following specification, drawing and appended claims.

BRIEF DESCRIPTION OF THE DRAWINGS

Similar reference characters designate corresponding parts throughout the several figures of the drawing.

DETAILED DESCRIPTION OF THE PREFERRED EMBODIMENTS

Figure 1:
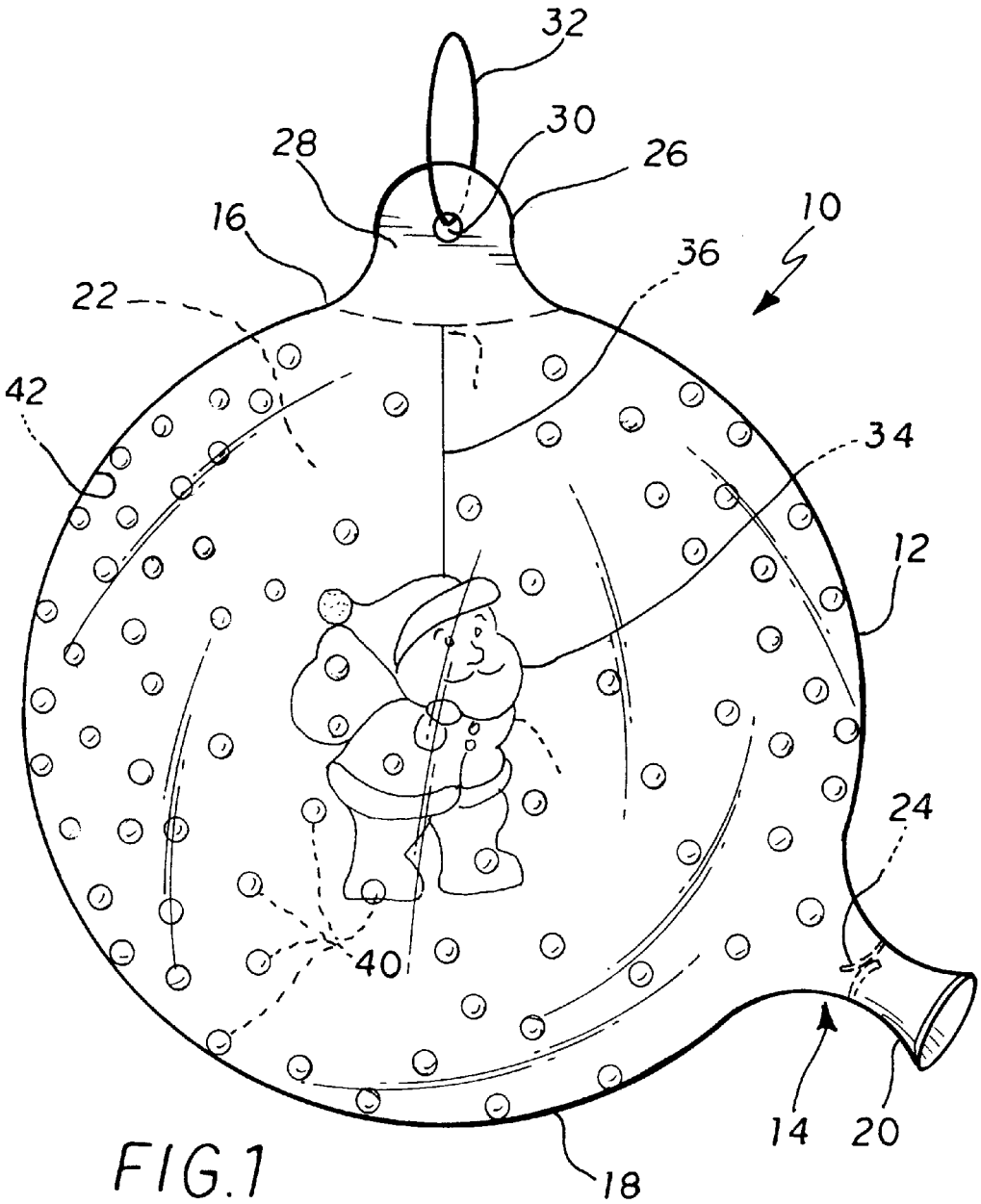
FIG. 1 is a front elevation of a typical ornament according to the present invention as it appears when ready for use.
Figure 2:
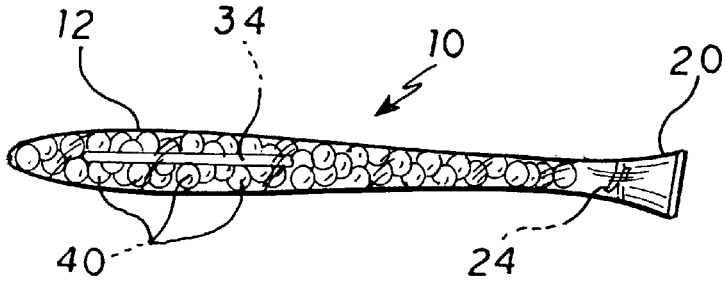
FIG. 2 is a side elevation of the device of FIG. 1 when in the deflated condition or ready for storage.

Referring now to the drawings, the present invention will be understood to relate to an ornament, generally designated 10 and although the example depicted herein is representative of a Christmas tree ornament, it will be appreciated that the concept of the invention will not be limited to this specific use. For example, the ornament 10 may be representative of any other desired theme, holiday or event and need not necessarily be hung from a Christmas tree limb.

The primary component of the ornament 10 is defined by the body, housing or member 12 which, in the drawings, represents a substantially circular configuration in plan but will be understood to define a generally spherical member when in the inflated, use position of FIG. 1. Alternative configurations are within the scope of the instant invention and may include heart-shaped, triangular, conical, star-shaped or any one of many other conceived shapes. These alternative configurations may involve a greater manufacturing expense by the requirement to form multiple mating pattern pieces and bonding same all about their abutting peripheries. A unitary, spherical, three-dimensional configuration on the other hand, lends itself to ready manufacture, akin to that of the common balloon.

In any case, the material of the housing or member 12 is preferably a soft, flexible, thermoplastic composition, such as polyvinyl chloride or PVC and for reasons which will become apparent hereinafter, the selected material is desirably transparent although special effects may be achieved by the use of a translucent material.

The flexible member 12 is provided with an air valve 14 which may be located at any suitable point on the member, such as intermediate the ornament top 16 and bottom 18. This valve 14 may comprise any well known construction such as commonly employed in PVC beach balls and which allows the user to selectively inflate and deflate the spherical member. In its most basic form, such a valve includes a projection or snout 20 which provides direct communication with the housing interior 22 as in the case of a conventional balloon. After a user orally inflates such a member, the projection 20 would be twisted, folded and then pushed into the housing interior 22 whereupon the positive pressure in the interior serves to retain the projection 20 within the confines of the housing. When deflation is desired, the user merely manipulates the projection to cause its withdrawal and allow the subsequent escape of air from the housing interior 22.

An alternative valve fixture is shown in FIG. 1 and includes a normally closed, flap valve element 24 within the projection 20. With this latter construction and during inflation, incoming air forces the valve element 24 to open while the greater pressure of the air as introduced into the interior 22 maintains the valve 14 closed. Deflation is readily accomplished by merely introducing a slim article, such as a pen or pencil, into the projection 20 in order to deflect the normally closed valve element 24. Quite obviously, any one of various other suitable valve constructions may be utilized to provide a simple manner of selectively inflating and deflating the member 12.

To allow hanging of the ornament 10 from any device, such as a peg or a tree limb (not shown), a hanging formation 26 is provided adjacent the top 16 of the member 12. This formation 26 may comprise a flattened, heat-sealed portion 28 provided with an aperture 30 adapted to receive a hanger element such as the illustrated loop 32. Alternatively, the user may employ a conventional J-hook tree ornament hanger (not shown) and which would engage the aperture 30, instead of the loop element 32.

A figurine will be seen to be disposed within the housing interior 22 and its appearance will be understood to be selected in accordance with the occasion desired to be associated with the specific ornament 10. The figurine 34 shown in FIG. 1 represents Santa Claus and would be an appropriate design in the case of a Christmas tree ornament, while any other suitable representation may be offered. Whatever the design of the figurine 34 and whether it is formed as a planar member or a three-dimensional member, the material of its construction should be selected from a relatively lightweight composition such as foamed plastics, paper-mache, cloth stuffed with lightweight material or the like.

The selected figurine 34 is captively suspended within the confines of the housing interior 22 through an elongated, flexible tether 36 having its upper end 38 suitably anchored at the top 16 of the member 12. This anchoring is most readily achieved at the time the housing flattened portion 28 is formed. The length of the tether 36 is selected to insure that the figurine 34 will be freely suspended within the member interior 22, clear of its bottom 18 when the member 12 is inflated.

An important aspect of the present invention is the inclusion of a somewhat particulate material serving to produce the effect of simulated snow within the ornament 10. This is accomplished by introducing a specific material 40 into the housing interior 22 and which naturally reacts with the composition of the housing 12 to randomly cling to the inner surface 42. The composition which has been found to produce the foregoing effect is foamed polystyrene, known under the trademark STYROFOAM of the Dow Chemical Company. The size of the foamed polystyrene particles depends upon the diameter of the ornament and its contained figurine, since it is desirable to maintain a sense of perspective. Typically, in the case of an ornament having a diameter of say 3–4 inches or 7–10 cm., the particles may be approximately 3–5 mm. in length or diameter to yield a most pleasing effect suggestive of individual snowflakes and resulting in a simulated snowfall surrounding the suspended figurine 34.

To enhance the static cling effect between the foamed polystyrene particles 40 and the housing inner surface 42, the vinyl composition employed in the manufacture of the housing 12 should not include any static-dissipative compound which is often included in common balloons, beach balls and the like.

From the foregoing it will be appreciated that an improved inflatable ornament is provided that may be readily stored in a collapsed, deflated condition but which is quickly inflated to present either a clear, colored or translucent member containing a figurine suspended within its confines, together with particles of foamed polystyrene clinging to the inner wall of the member to replicate snowflakes.

It will be understood that the present invention is not limited to the embodiments described hereinabove, but encompasses any and all embodiments within the scope of the appended claims.

I claim:

1. A hanging ornament comprising:

a housing of flexible material having a top and a bottom and defining an interior;

an air valve in said housing permitting selective inflation and deflation of said housing;

a figurine within said housing interior;

particulate material disposed within said housing interior; and said housing material and particulate material selected from materials exhibiting a natural tendency therebetween resulting in the shiftable clinging of said particulate material to said housing in a scattered manner.

2. A hanging ornament according to claim 1 wherein:

said housing flexible material includes a thermoplastic plastics composition.

3. A hanging ornament according to claim 2 wherein:

said plastics composition comprises polyvinyl chloride.

4. A hanging ornament according to claim 1 including:

an elongated tether respectively attached to said figurine and said housing top.

5. A hanging ornament according to claim 4 wherein:

said tether has a predetermined length dimension, such that it freely suspends said figurine intermediate said housing top and bottom.

6. A hanging ornament according to claim 1 wherein:

said particulate material includes foamed polystyrene.

7. A hanging ornament according to claim 6 wherein:

said foamed polystyrene particulate material defines a majority dimension between 3–5 mm.

8. A hanging ornament according to claim 1 including:

a hanging formation at said housing top.

9. A hanging ornament according to claim 1 wherein:

said housing material is substantially transparent.

10. A hanging ornament according to claim 1 wherein:

said housing material is translucent.

11. A hanging ornament according to claim 1 wherein:

said housing material comprises transparent polyvinyl chloride, and there is a tether extending from said housing top and supporting said figurine in a suspended manner within said housing.

* * * * *